US007644465B1

(12) United States Patent
Bently

(10) Patent No.: US 7,644,465 B1
(45) Date of Patent: Jan. 12, 2010

(54) COMPONENT BRUSH SYSTEM

(76) Inventor: John F Bently, 11153 S. Wilton River Rd., New Richland, MI (US) 56072

( * ) Notice: Subject to any disclaimer, the term of this patent is extended or adjusted under 35 U.S.C. 154(b) by 802 days.

(21) Appl. No.: 11/056,687

(22) Filed: Feb. 11, 2005

Related U.S. Application Data

(60) Provisional application No. 60/545,348, filed on Feb. 17, 2004.

(51) Int. Cl.
*A46B 13/00* (2006.01)

(52) U.S. Cl. ..... 15/179; 15/104.05

(58) Field of Classification Search ..... 15/179–180, 15/104.05, 104.09, 104.095, 104.096
See application file for complete search history.

(56) References Cited

U.S. PATENT DOCUMENTS

| | | | | |
|---|---|---|---|---|
| 128,290 | A | 6/1872 | Dimes | |
| 462,156 | A | 10/1891 | Pederson | |
| 505,761 | A | 9/1893 | Fludder et al. | |
| 592,267 | A | 10/1897 | Wye | |
| 860,579 | A | 7/1907 | Sholdebrand | |
| 1,126,961 | A | 2/1915 | Denney | |
| 1,323,964 | A | 12/1919 | Clegg | |
| 1,338,917 | A | 5/1920 | Hall | |
| 1,685,380 | A | 9/1928 | Shultz | |
| 1,917,383 | A | 7/1933 | McCarthy | |
| 1,970,302 | A * | 8/1934 | Gerhardt | 15/183 |
| 2,057,842 | A | 10/1936 | Nielsen | |
| 2,544,847 | A | 3/1951 | Malesky | |
| 2,599,077 | A | 6/1952 | Sturgis | |
| 2,763,257 | A | 9/1956 | Asbury | |
| 3,120,020 | A | 2/1964 | Schell | |
| 3,381,754 | A | 5/1968 | Tompkins | |
| 4,144,610 | A | 3/1979 | Moore et al. | |
| 4,534,080 | A | 8/1985 | Young et al. | |
| 4,666,530 | A * | 5/1987 | Houser | 134/22.1 |
| 5,257,435 | A | 11/1993 | Brewster | |
| 5,369,834 | A | 12/1994 | Groen et al. | |
| 5,383,243 | A | 1/1995 | Thacker | |
| 5,406,669 | A * | 4/1995 | Lesiw | 15/179 |
| 5,617,609 | A | 4/1997 | Bently | |
| 5,819,354 | A | 10/1998 | Alonso et al. | |
| 5,819,355 | A | 10/1998 | Wu | |
| 6,058,547 | A * | 5/2000 | Foster | 15/104.12 |
| 6,490,750 | B2 * | 12/2002 | Shia et al. | 15/179 |

FOREIGN PATENT DOCUMENTS

| | | |
|---|---|---|
| DE | 2155733 | 3/1973 |
| GB | 237965 | 8/1925 |
| SE | 98190 | 2/1940 |
| SU | 1087129 A | 4/1984 |

* cited by examiner

*Primary Examiner*—Laura C Guidotti

(57) ABSTRACT

A component brush system for use with a drive shaft, including at least two connectable-disconnectable members. Each connectable-disconnectable member has a top surface, a bottom surface and a middle sandwiched between the top and bottom surfaces. At least one of the connectable-disconnectable members has at least one groove disposed in at least a portion of at least one of its top or bottom surfaces. The groove is located between the connectable-disconnectable members when they are connected together. The system includes at least one elongate flexible cleaning member. At least a portion of the cleaning member is located within the groove and is secured in place between the connectable-disconnectable members and a remainder of the cleaning member extends away therefrom. At least one the connectable-disconnectable members includes a drive shaft joint where the drive shaft is removably connectable with the connectable-disconnectable member.

33 Claims, 10 Drawing Sheets

COMPONENT BRUSH SYSTEM

PRIOR APPLICATION

This application claims the benefit of U.S. Provisional Application No. 60/545,348 filed Feb. 17, 2004.

BACKGROUND OF THE INVENTION

Generally, this invention relates to a brush for use with a drive shaft, for example, to assist in removing undesirable dust, dirt and other debris from remote locations, specifically for dislodging such dust, dirt and other debris from areas which are difficult to reach, and therefore require special means to clean.

For dislodging dust or unwanted debris from remote, difficult to reach locations, such as the interior of air ducts or chimneys, many different means have been employed. Most air duct cleaners use vacuum equipment to induce rapid airflow within ductwork or chimneys, creating a tendency for loose dust or debris to be drawn along with the air. However, this rapid airflow does not remove dust or unwanted material which has become settled or lodged on interior surfaces. Such debris often builds up gradually over time, and has frequently formed a cohesive "pad" which cannot be removed by rapid airflow alone.

One of the longest-standing methods for dislodging such unwanted dust and debris is the introduction of fast-moving air directed by nozzles. While using nozzles alone does dislodge some of the material and does break up "pads" of material on the bottom of ductwork, thus allowing some of the unwanted material to be drawn away by rapid airflow, such nozzles do not, always and/or easily, remove all material, and so must be introduced to an area several times to dislodge the more difficult dust or dirt that is left behind. Also, since the effectiveness of a nozzle depends both upon the operators' ability to see the unwanted material and the nozzle, and upon the operators' ability to maneuver the nozzle toward uncleaned areas, using nozzles can be relatively inefficient when it is difficult to see into the remote area being cleaned.

Another common method for dislodging dust or unwanted material from remote areas is to introduce brushes, and particularly rotating brushes. Brushes often have a larger effective cleaning radius than nozzles. However, existing brushes exhibit several disadvantages. For example, existing brushes come in one size or shape, and with parts that have rather short lifetimes. This means that a brush user must purchase and maintain many different brushes, especially if they service many different kinds of ducts or chimneys. Also, over the course of their life, often times it is the bristles or bristle-like parts of the rotating brush that wear out long before the hub of the brush does. Consequently, a new type of brush is needed which will provide the advantages of existing brushes, but without one or more of the related disadvantages.

SUMMARY OF THE INVENTION

The present invention is directed to avoiding one or more of the just discussed shortcomings. More particularly, the invention concerns a new component brush system that can assist in cleaning ducts, chimneys and the like. For example, this advantageous to enable replacement of components that tend to wear out sooner than others. Also, the invention can enable various sizes and types of brushes to be built from connectable-disconnectable components in a build-it-your-way fashion. For these and other reasons, the present invention can make brushes, and particularly rotating brushes used with drive shafts, more versatile, economical and/or reliable than those that presently exist.

One existing drive shaft system for which the present invention may bring an improvement, is seen in Applicant's granted U.S. Pat. No. 5,617,609 entitled "AIR NOZZLE/FLEXIBLE WHIP CLEANING MEANS FOR DUCTWORK", which is incorporated fully herein by reference. An example of a locking coupler with which the present invention may be used, is seen in Applicant's separate provisional patent application also filed the same date as this one, that is titled "LOCKING COUPLER FOR A DRIVE SHAFT", which is incorporated fully herein by reference.

The versatility, simplicity and durability of the new component brush system may further advantage it over any prior device. All this can be accomplished, for example, with some or all of the features of the present component brush system.

The invention concerns a component brush system for use with a drive shaft. The system includes at least two connectable-disconnectable members. Each connectable-disconnectable member has a top surface, a bottom surface and a middle sandwiched between the top and bottom surfaces. At least one of the connectable-disconnectable members has at least one groove disposed in at least a portion of at least one of its top or bottom surfaces. The at least one groove is located between the connectable-disconnectable members when the connectable-disconnectable members are connected together. the system also includes at least one elongate flexible cleaning member having a proximal end and a distal end. At least a portion of the cleaning member is located within the at least one groove and is secured in place between the connectable-disconnectable members when the connectable-disconnectable members are connected together. A remainder of the cleaning member extends away from the connectable-disconnectable members. At least one the connectable-disconnectable members includes a drive shaft joint where the drive shaft is removably connectable with at least one of the connectable-disconnectable members.

The invention also concerns optional features for a component brush system for use with a drive shaft. The system includes at least two identical connectable-disconnectable members. Each connectable-disconnectable member has a top surface, a bottom surface and a middle sandwiched between the top and bottom surfaces. The system also includes at least a third connectable-disconnectable member. The third connectable-disconnectable member has a top surface, a bottom surface and a middle sandwiched between the top and bottom surfaces. The at least two identical connectable-disconnectable members are connectable together independent of the third connectable-disconnectable member. At least one groove is disposed in at least a portion of each of the top and bottom surfaces of the at least two identical connectable-disconnectable members. At least one groove is also disposed in at least a portion of the bottom surface of the third connectable-disconnectable member. At least one elongate flexible cleaning member is located within at least one of the at least one grooves and secured in place between each connectable-disconnectable member for a total of at least two cleaning members when the at least two and the at least a third connectable-disconnectable members are connected together. A remainder of the cleaning members extends away from the connectable-disconnectable members. The third connectable-disconnectable member includes an axial bore located perpendicularly through at least the top surface and a portion of the middle of the third connectable-disconnectable member whereby the drive shaft is removably connectable with the third connectable-disconnectable member.

Still further, the invention concerns various optional configurations and relationships for the connectable-disconnectable members, for the groove(s), for the cleaning member(s), and for the drive shaft joint.

These and other features and functions of the present invention will be explained and understood upon reviewing the following detailed description and with reference to the accompanying drawings.

Figure 1:
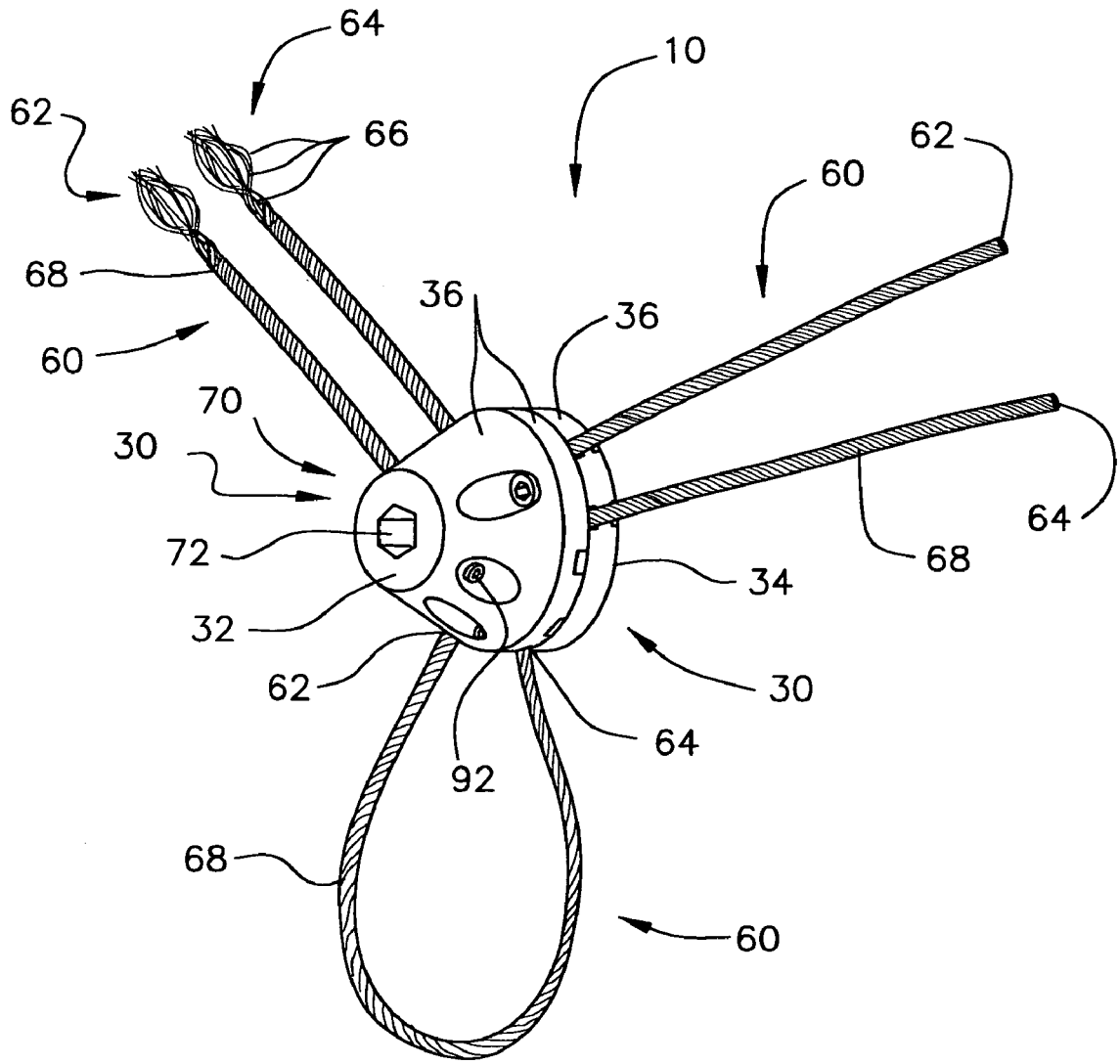
FIG. 1 is a top perspective view of the invention with three cleaning members located therein and each formed as a cleaning member type from the group consisting of a loop, a pair of extended ends, and a pair of extended ends with at least a partially exposed portion.
Figure 2:
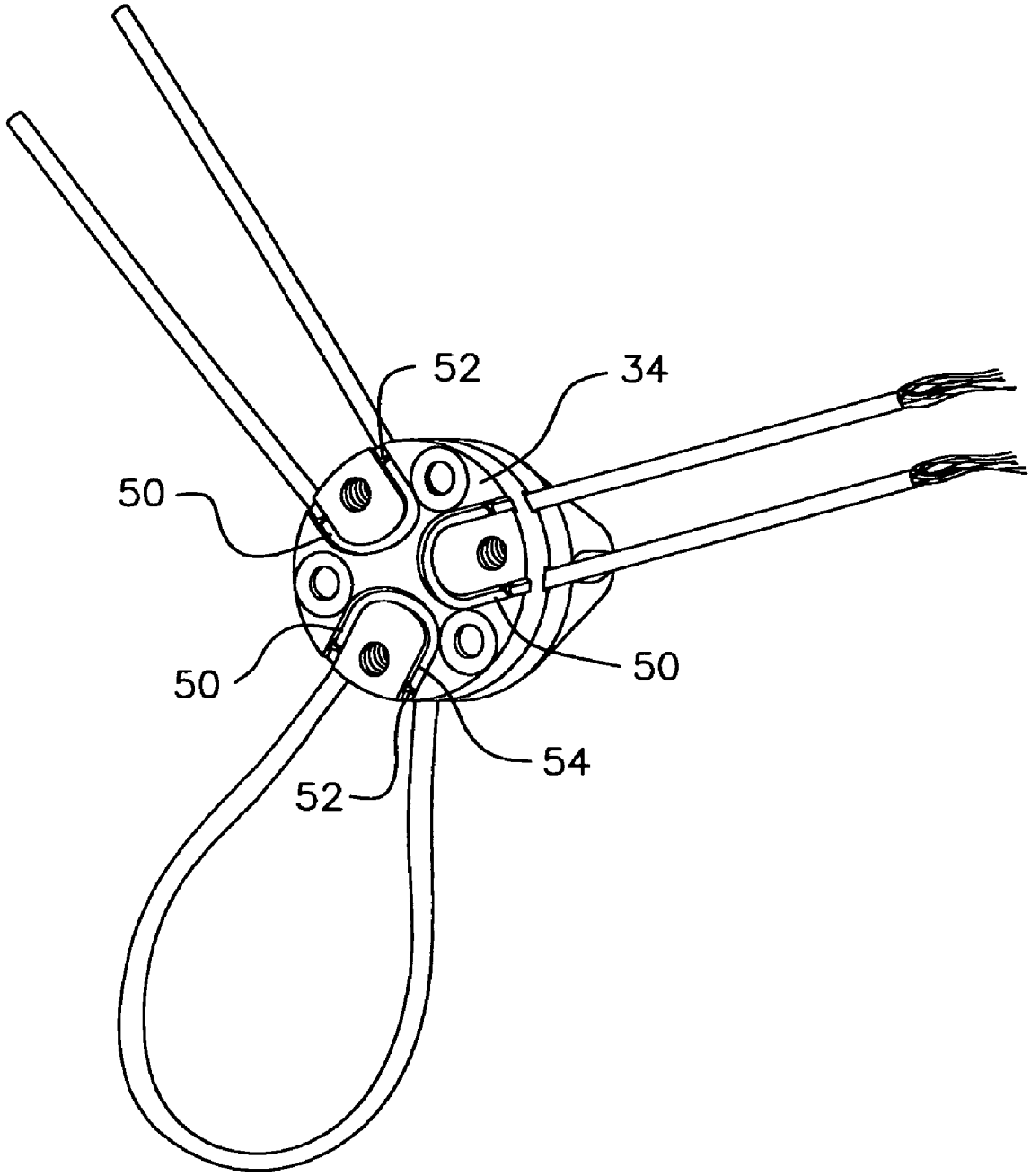
FIG. 2 is a bottom perspective view of the invention seen in FIG. 1.
Figure 3:
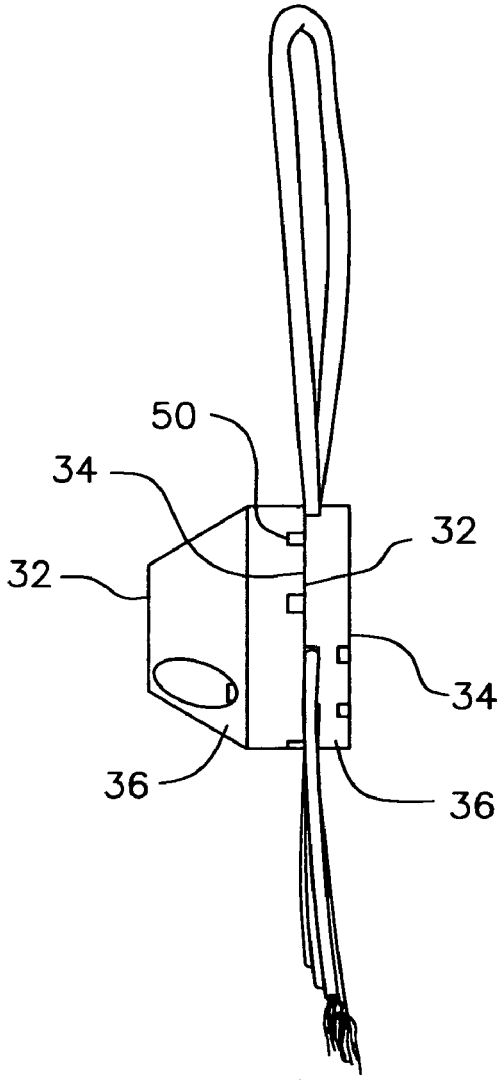
FIG. 3 is a side view of the invention seen in FIG. 1.
Figure 3A:
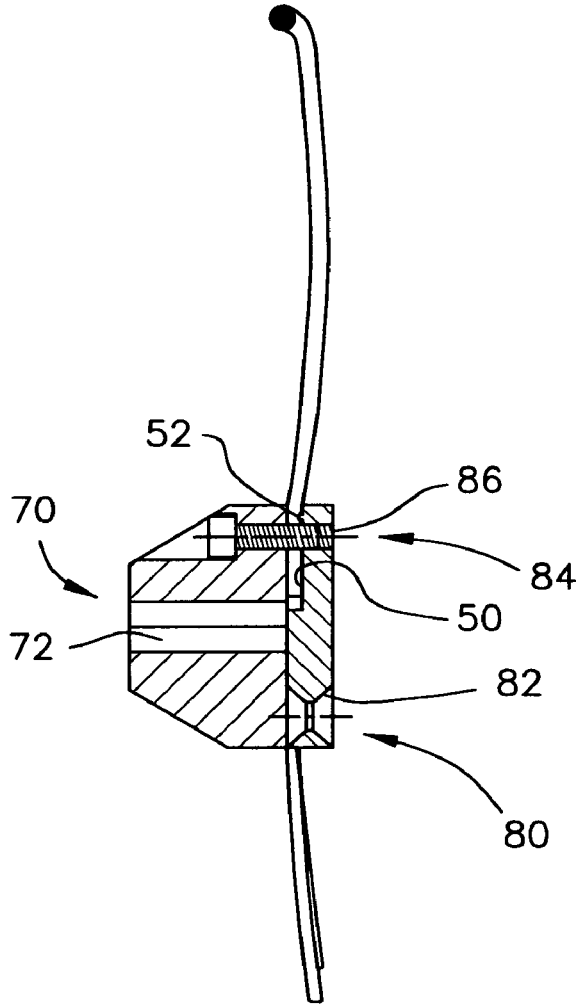
FIG. 3A is a cross-sectional side view of the invention seen in FIG. 3.
Figure 4:
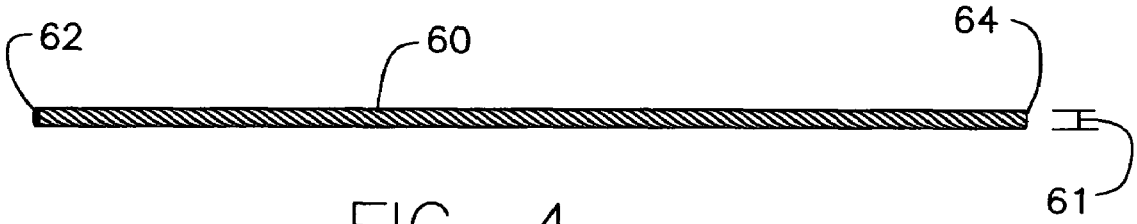
FIG. 4 is a top view of a cleaning member.
Figure 5:
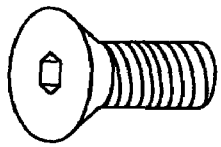
FIG. 5 is a perspective view of a connecting screw with a flared head.

It should be noted that the drawings are not drawn to scale, and the sizes of the components shown and their features could be varied as desired, as long as otherwise consistent with the teachings herein.

DETAILED DESCRIPTION OF THE INVENTION

Referring to the Figures, and particularly FIGS. 1-7 inclusive and 15, for example, there is seen a component brush system 10 for use with a drive shaft, such as drive shaft portion 22. The brush system includes at least two connectable-disconnectable members 30. Each connectable-disconnectable member has a top surface 32, a bottom surface 34 and a middle 36 sandwiched between the top and bottom surfaces. At least one of the connectable-disconnectable members has at least one groove 50 disposed in at least a portion of at least one of its top or bottom surfaces 32, 34. The at least one groove is located between the connectable-disconnectable members when the connectable-disconnectable members are connected together. the system also includes at least one elongate flexible cleaning member 60 having a proximal end 62 and a distal end 64. At least a portion of the cleaning member is located within the at least one groove and is secured in place between the connectable-disconnectable members when the connectable-disconnectable members are connected together. A remainder of the cleaning member extends away from the connectable-disconnectable members, and such engages with surfaces to be cleaned when brush system 10 is rotated by a drive shaft. In this regard, at least one the connectable-disconnectable members includes a drive shaft joint 70 where the drive shaft is removably connectable with at least one of the connectable-disconnectable members.

For example, a locking coupler 20 for a drive shaft, such as representative drive shaft portion 22, may be used to removably connectable brush system 10 to the drive shaft. Generally, the coupler 20 includes a male member 24, a female member 26 and a detent 28, that cooperate to connect and disconnect the drive shaft from the brush system. Advantageously, though not required, a mating keyed drive shaft portion 29 of female member 26 may be used to connect with drive shaft joint 70, for example via an axial bore 72 that is similarly shaped to receive portion 29. If so used, a set screw location 90 with threads 86 therein may be used with set screw 92 to secure system 10 to shaft portion 29.

The invention may also include a variety of other features. For example, and referring to FIGS. 13-14 as well, the component brush system 110 may include at least two identical connectable-disconnectable members 130, each connectable-disconnectable member having a top surface, a bottom surface and a middle sandwiched between the top and bottom surfaces. Further, it may include at least a third connectable-disconnectable member 230, the third connectable-disconnectable member having a top surface, a bottom surface and a middle sandwiched between the top and bottom surfaces. The connectable-disconnectable members 130 may be connectable together independent of the third connectable-disconnectable member, as described further herein. Also, at least one groove 50 is disposed in at least a portion of each of the top and bottom surfaces of the connectable-disconnectable members 130 and at least one groove 50 is disposed in at least a portion of the bottom surface of the third connectable-disconnectable member 230. Still further, at least one elongate flexible cleaning member 60 is located within at least one of the at least one grooves and secured in place between each connectable-disconnectable member 130, 230 for a total of at least two cleaning members 60 when the connectable-disconnectable members 130 and 230 are connected together. Further then, a remainder of the cleaning members 60 extends away from the connectable-disconnectable members 130, 230. Still further, the third connectable-disconnectable member 230 includes an axial bore 72 located perpendicularly through at least the top surface and a portion of the middle of the third connectable-disconnectable member whereby the drive shaft is removably connectable with the third connectable-disconnectable member 230. Yet further, brush system 110 may include a fourth connectable-disconnectable member 330, the fourth connectable-disconnectable member having a top surface, a bottom surface and a middle that is at least in part bulbous shaped sandwiched between the top and bottom surfaces, and at least one groove disposed in at least a portion of the top surface of the fourth connectable-disconnectable member 330.

Additionally, or alternatively, and referring to all of the Figures, the connectable-disconnectable members 30, 130, 230, 330 may be disk shaped, may have top surfaces and/or bottom surfaces that are planar or more particularly planar in both an x-dimension 38 and a y-dimension 40, may be include a middle that is at least in part conical shaped (e.g., seen as 42) or may include a middle that is at least in part bulbous shaped (e.g., seen as 44).

Figure 6:
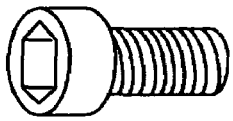
FIG. 6 is a perspective view of a connecting screw with a flat head.
Figure 7:
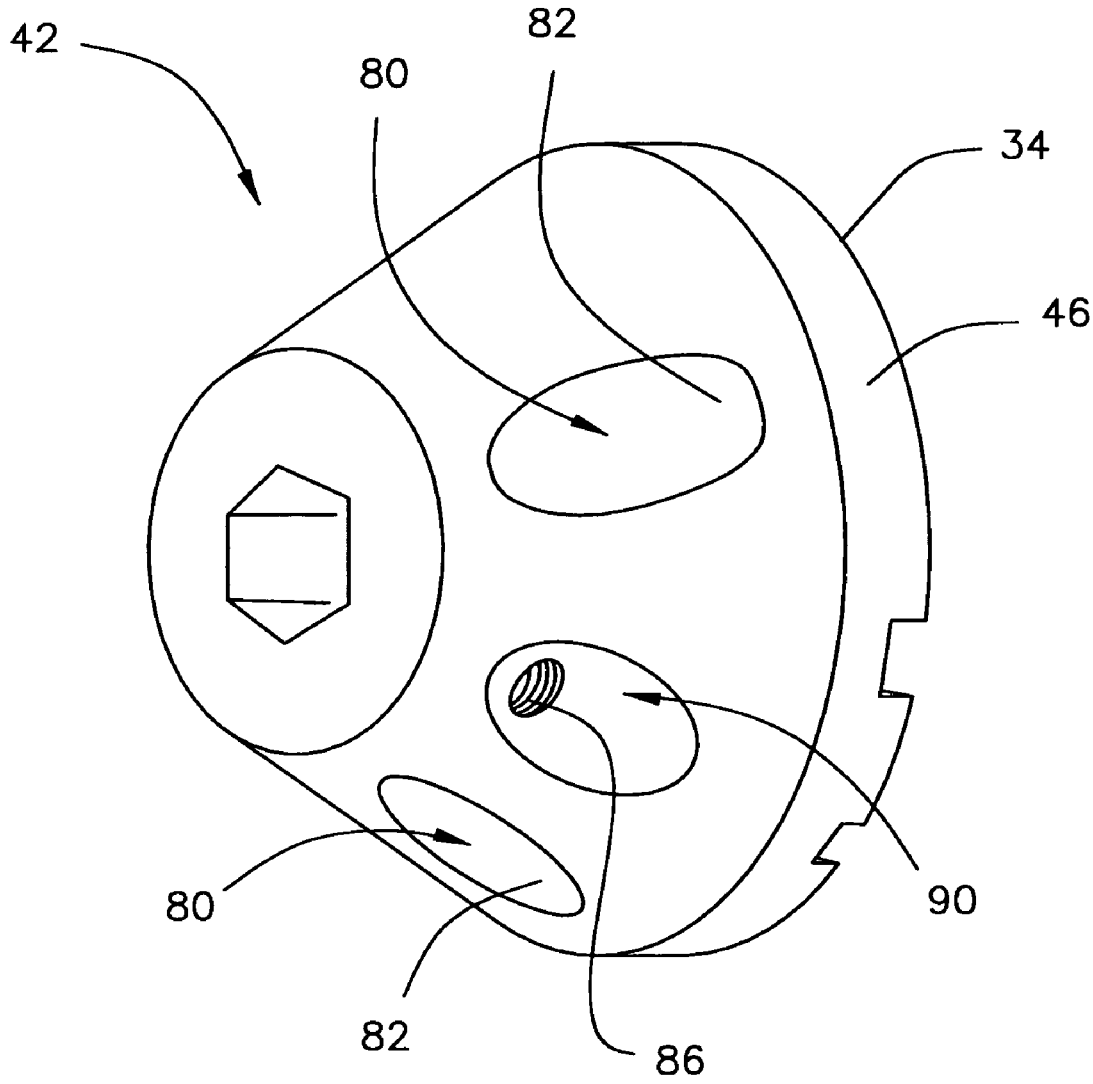
FIG. 7 is an enlarged perspective view of the at least in part conical shaped connectable-disconnectable member seen in FIG. 1.

Other features the invention may include are where the connectable-disconnectable members include a first type of hole 80 and/or a second type of hole 84, each type of hole located perpendicularly through the top and bottom surfaces and middle and being positioned closer to a circumference 46 of the connectable-disconnectable member that to a center of the connectable-disconnectable member. The first type of hole 80 includes a recessed portion 82 and is free of threads. The second type of hole 84 includes threads 86 for securing a screw therein. The first type of holes may be located generally equidistant from each adjacent first type of hole. The second type of hole may be located generally equidistant from each adjacent second type of hole. The first and second type of holes may be located alternately about the circumference of the connectable-disconnectable member such that no two first type of holes are located adjacent each other. The first and second holes may interact such that the first type of hole is located adjacent and superposes the second type of hole when any two adjacent connectable-disconnectable members are connected together. In this way, a first type of screw with a flared head (FIG. 5) passes through the first type of hole and screws into the second type of hole to connect the two adjacent members, and only the two adjacent members, together. When a third connectable-disconnectable member is desired to be connected to the first two connectable-disconnectable members, the third can be done so with only the adjacent member. Thus, the connectable-disconnectable members may be connectable together independent of the third connectable-disconnectable member, fourth connectable-disconnectable member, etc. All of this readily enables the build-it-your-way feature for the brush system of the invention, if desired. When connecting a connectable-disconnectable member like that seen in FIG. 1, first type holes 80 may be used with a flat head screw (FIG. 6).

Figure 8:
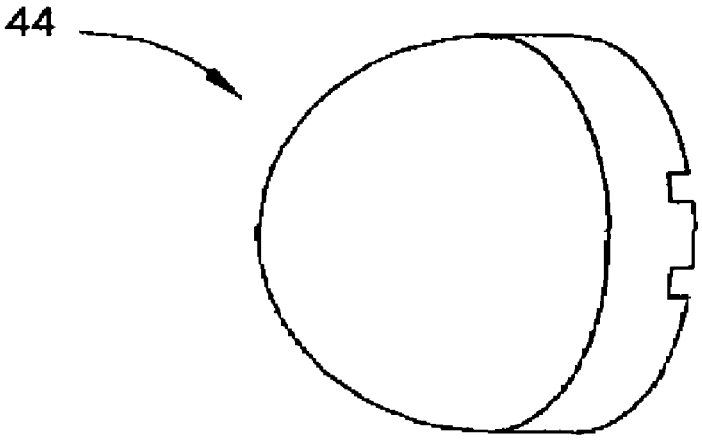
FIG. 8 is a perspective view of an alternate connectable-disconnectable member of the invention, which is at least in part bulbous shaped.
Figure 9:
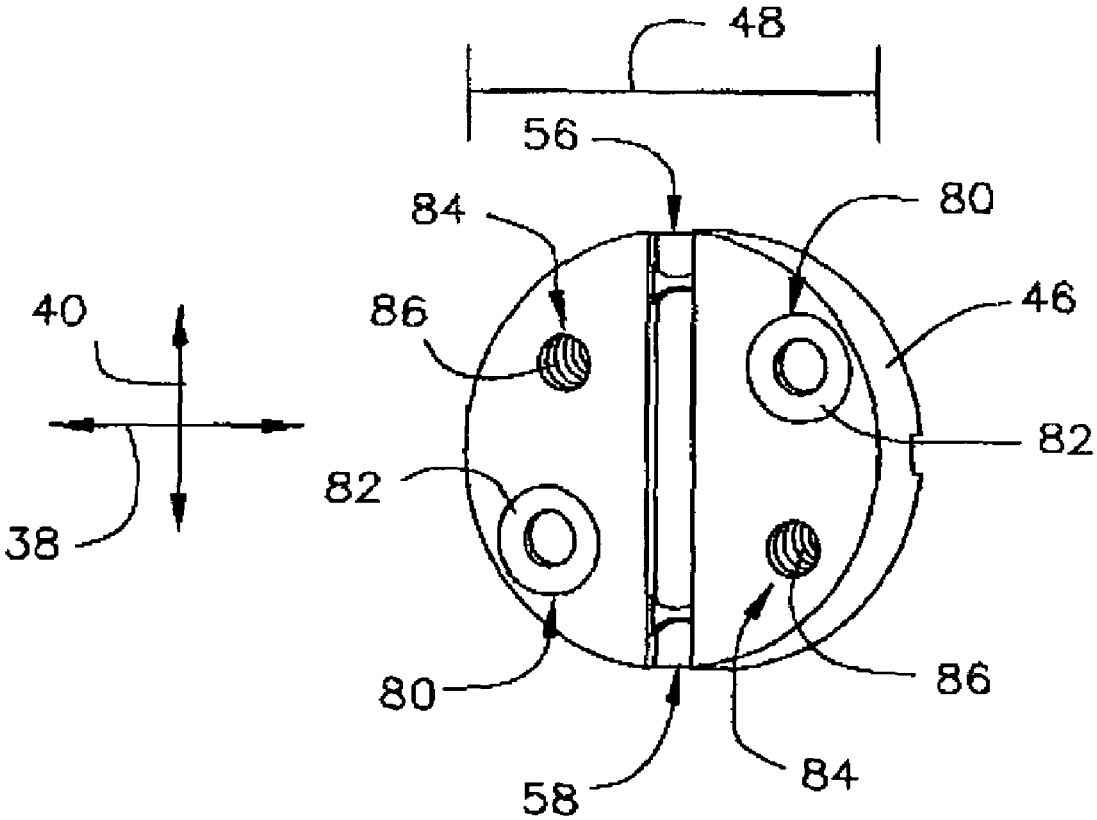
FIG. 9 is a top perspective view of another alternate connectable-disconnectable member of the invention, where the bottom perspective view is a mirror image thereof except for the groove which is rotated 90 degress relative to the groove in the top perspective view but both grooves could have the same orientation.
Figure 11:
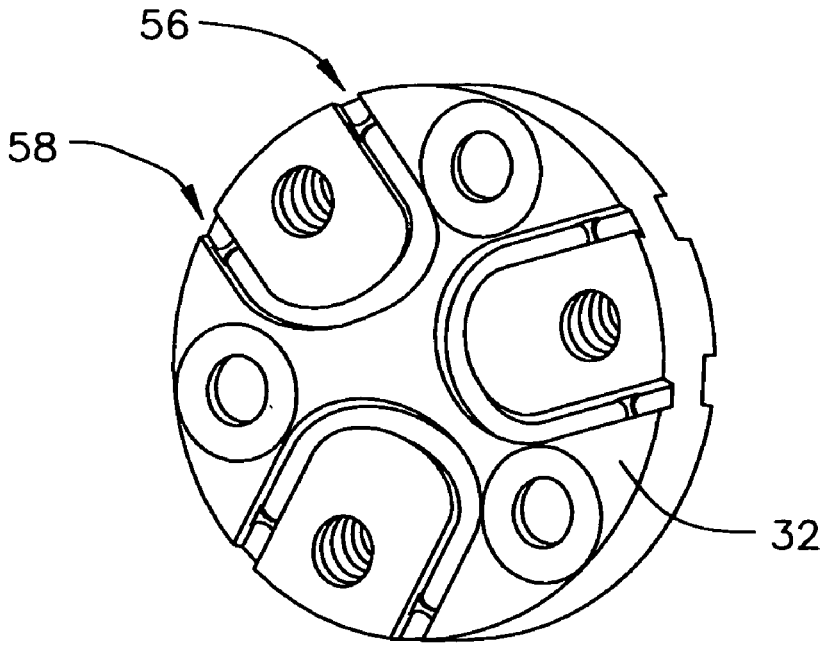
FIG. 11 is a top perspective view of another alternate connectable-disconnectable member of the invention, where the bottom perspective view is a mirror image thereof.

Still other features the invention may include depend upon a diameter 48 across each member 30 top and bottom surfaces and the diameter of adjacent top and bottom surfaces. such diameters of adjacent members 30 may be the same (generally as shown) or different (not shown). The bottom surface 34 of member 30 seen in FIG. 7 (and 130 seen in FIG. 13) is identical to the top surface 32 of member 30 seen in FIG. 11 except that it need not include second type of holes 84 which are threaded. Similarly, The top surface 32 of member 30 seen in FIG. 8 9 and 330 seen in FIG. 13) is identical to the top surface 32 of member 30 seen in FIG. 11 except that it need not include first type of holes 80 which are free of threads.

Figure 10:
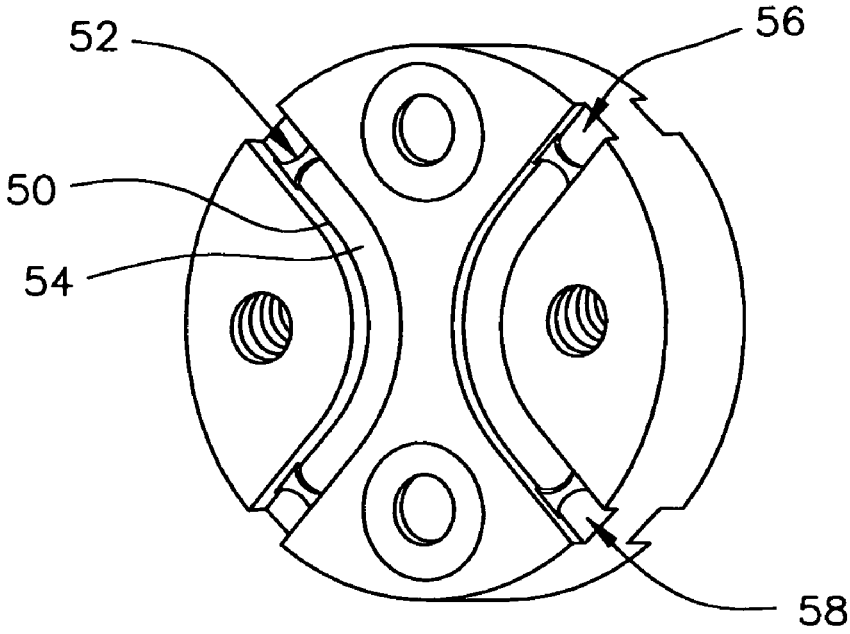
FIG. 10 is a top perspective view of another alternate connectable-disconnectable member of the invention, where the bottom perspective view is a mirror image thereof.
Figure 12:
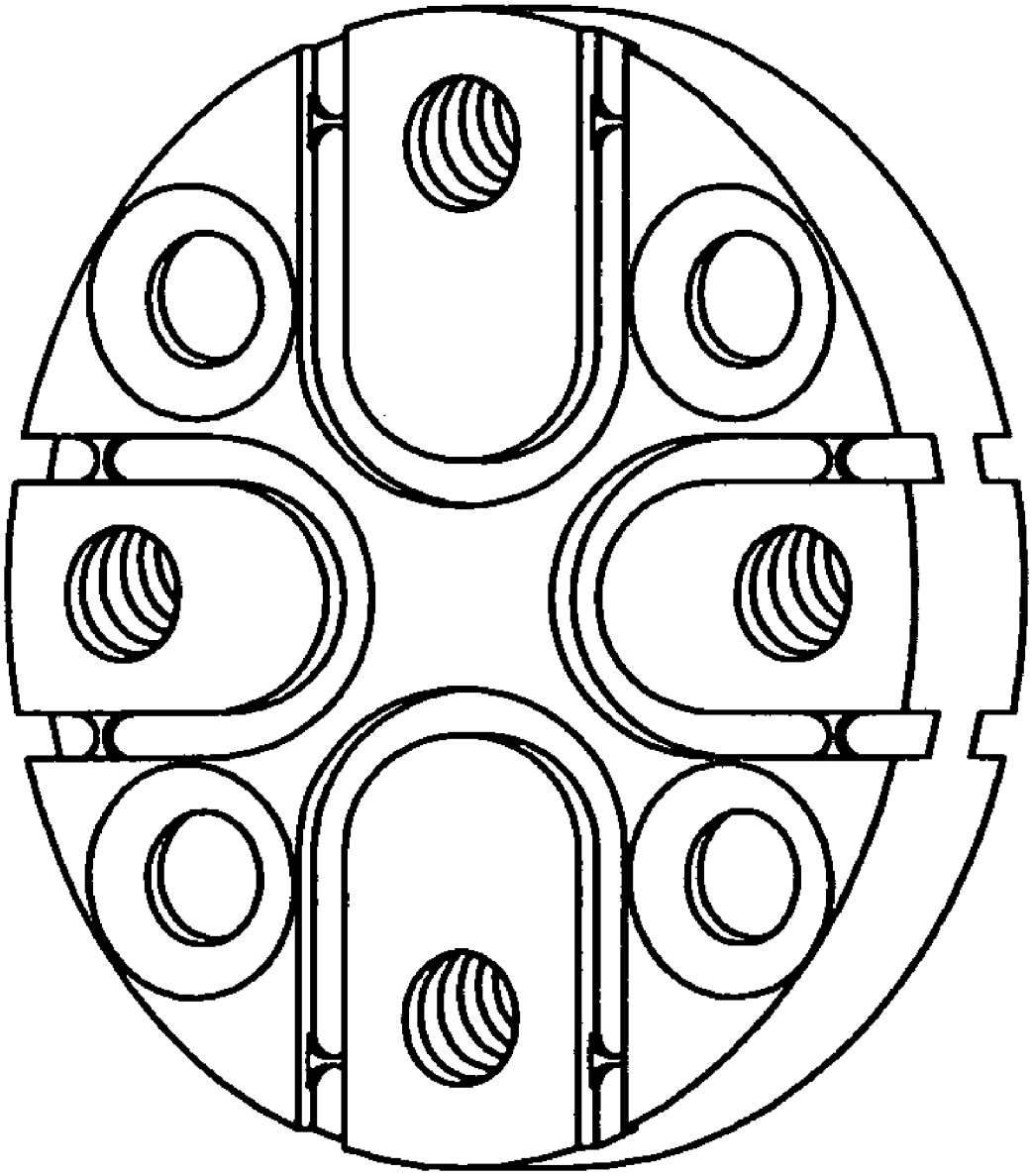
FIG. 12 is a top perspective view of another alternate connectable-disconnectable member of the invention, where the bottom perspective view is a mirror image thereof.

Yet other features the invention may include concern the groove(s) 50. Grove(s) 50 may include a detent which assists in securing the cleaning member in place between the connectable-disconnectable members. The detent may be a ridge 52 within a bottom 54 of the groove which extends away from the bottom of the groove towards the surface of the connectable-disconnectable member. The detent may be the groove being sized smaller than a diameter of the cleaning member. The groove may have a first end 56 and a second end 58 where at least one end intersects with a circumference 46 of the connectable-disconnectable member. Further, each end 56, 58 may intersect with the circumference 46. Still further, the groove may be U-shaped. As seen in detail in FIGS. 10-12, the at least one groove may be at least two pairs of grooves 50. Further in this regard, each pair of grooves may be located about a circumference of the connectable-disconnectable member generally equidistant from each adjacent pair of grooves. Still further, at least one groove may be disposed in both the top surface 32 and the bottom surface 34.

Further optional features the invention may include concern cleaning member 60. For example, at least one of the distal end 64 or proximal end 62 of the cleaning member may be secured in place between the connectable-disconnectable members. As another example, both the distal end 64 and the proximal end 62 may be secured in place between the connectable-disconnectable members such that the cleaning member forms a loop. Further in this regard, the secured ends 64, 62 may be spaced apart from each other at the circumference 46 of the connectable-disconnectable member. As yet another example, the cleaning member may be secured in place between the connectable-disconnectable members at a middle portion (not shown) where the member would engage the entire groove and the proximal end 62 and the distal end 64 would extend away from the connectable-disconnectable members. Still another example concerns the cleaning member being multiple pairs of elongate flexible cleaning members and each pair of cleaning members being located about a circumference of the connectable-disconnectable member generally equidistant from each adjacent cleaning member pair.

As yet other examples of option features, the cleaning member may include multiple strands 66 of elongate material, e.g., wire or the like. Further in this regard, the multiple strands may be enclosed by a sheath 68. And, an outer portion of a member with a sheath may have at least a portion that is free of the sheath such that the multiple strands can readily separate from each other.

Figure 13:
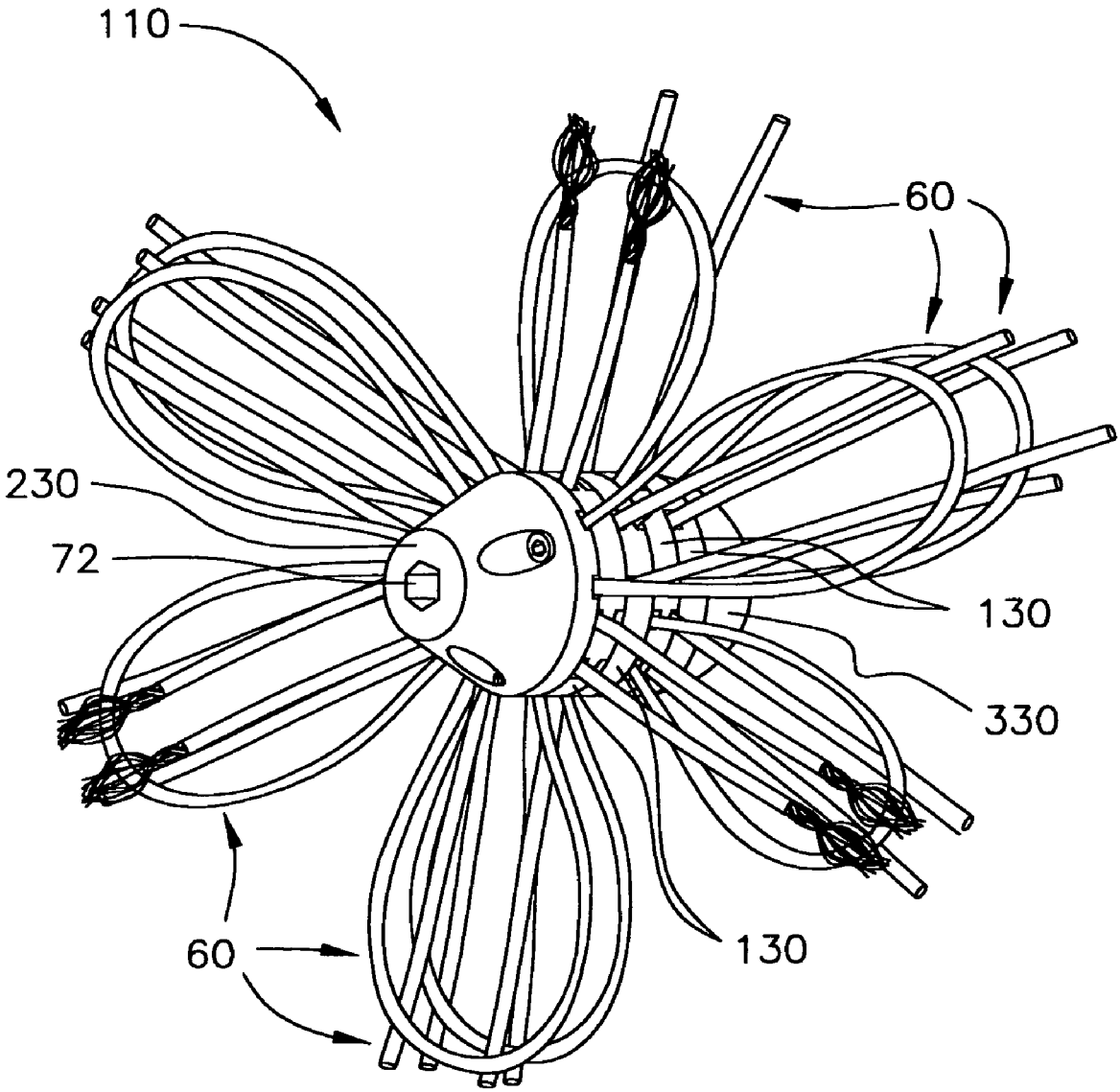
FIG. 13 is a top perspective view of an alternate embodiment of the invention, and depicts multiple connectable-disconnectable members and cleaning members located therein.
Figure 14:
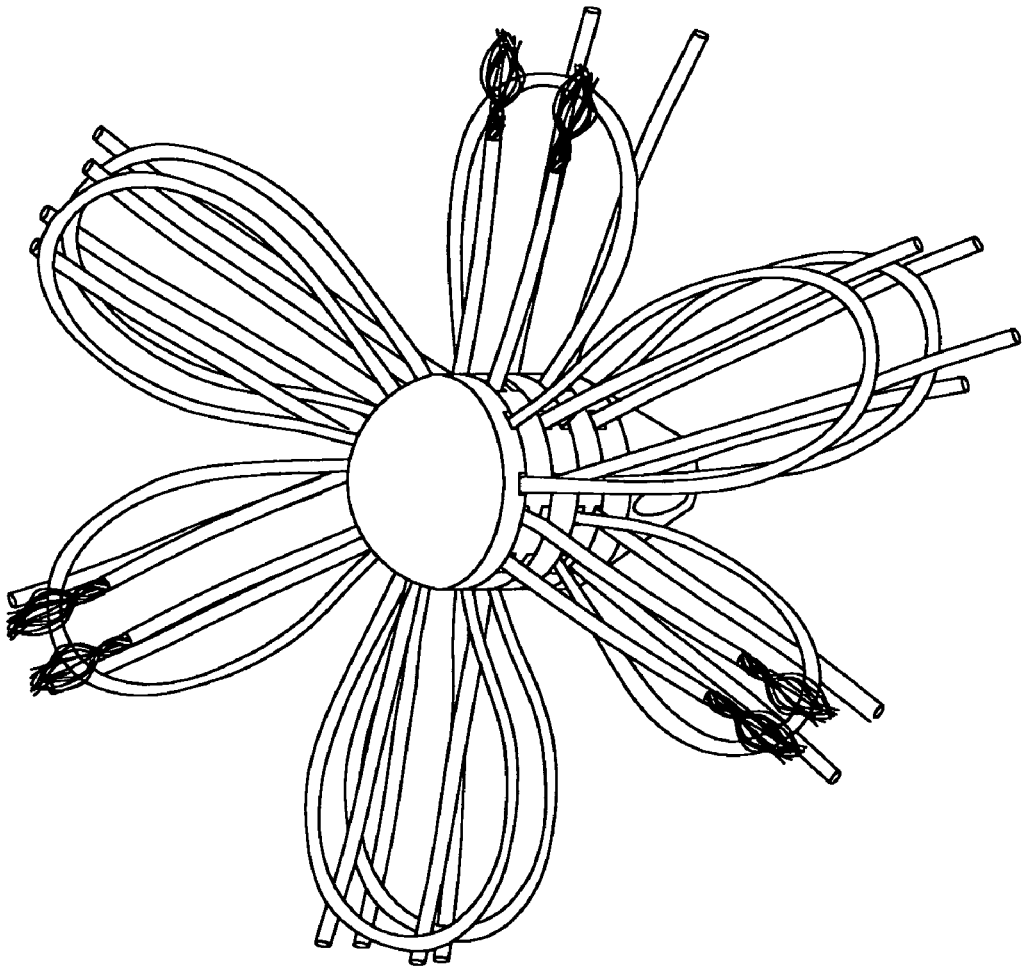
FIG. 14 is a bottom perspective view of the invention seen in FIG. 13.
Figure 15:
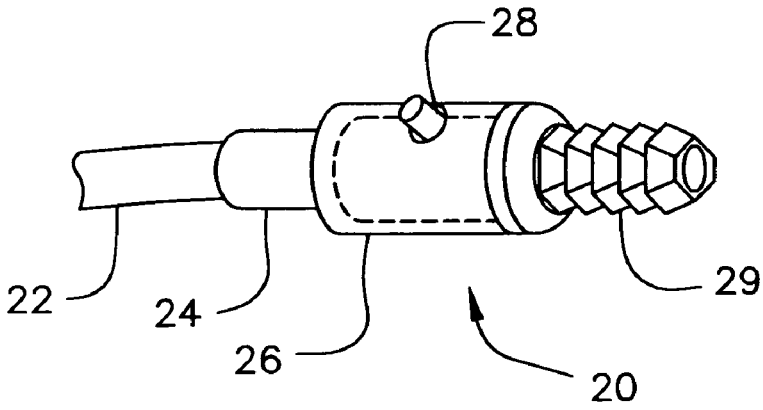
FIG. 15 is a perspective view of a portion of a drive shaft for use with the invention.

Various sized and configured connectable-disconnectable members may be connected together to build a component brush system of the invention. While not required, it is believed to be advantageous to use connectable-disconnectable members that are identical, except for the end most members which would have at least one similar surface to the adjoining members (as seen in FIGS. 13-14). When connecting multiple connectable-disconnectable members, then a variety of cleaning member configurations maybe employed from all the same, to all different, to some the same and some different. Also, such cleaning member configurations may vary from one pair of connectable-disconnectable members to another, i.e., from layer to layer. And, the layers may be offset so as to not superpose one another and thereby even form a stair step pattern, if desired.

The brush components may be made of various materials. Such materials advantageously have a rigid characteristic so as to be able to endure the rotational torque stresses the brush system will be subjected to during its intended lifetime. For example, these may be metals, plastics and substitutes therefor as would be known to those of skill in the art, and such things as steel, galvanized steel and molded plastics may be employed. The brush components may be formed by conventional techniques such as cutting, grinding, molding, forging or other forming means. connectable-disconnectable members, and their variety of features, may be made to various sizes as long as the relative relationships between certain components, as discussed above, are maintained as desired. Otherwise, generally, the size for which the brush is intended and the desired attributes of the brush, will dictate the overall size of the components and their features, as would be known to one of ordinary skill in the art in combination with the teachings herein.

While the invention has been described in connection with various features and advantages, such is not intended to limit the scope of the invention to the particular form set forth, but, on the contrary, the invention is intended to cover such alternatives, modifications and equivalents as may be defined by the scope of the following claims.

What is claimed is:

1. A component brush system for use with a drive shaft comprising:

at least two connectable-disconnectable members, each connectable-disconnectable member having a top surface, a bottom surface and a middle sandwiched between the top and bottom surfaces;

at least one of the connectable-disconnectable members having at least one groove disposed in at least a portion of at least one of its top or bottom surfaces, wherein the at least one groove is located between the connectable-disconnectable members when the connectable-disconnectable members are connected together;

at least one of the connectable-disconnectable members including a first type of hole and a second type of hole, each hole located perpendicularly through the connectable-disconnectable members top and bottom surfaces and middle and being positioned off center of the connectable-disconnectable member, wherein the first type of hole is a different type of hole than the second type of hole and the second type of hole includes threads for securing a screw therein;

at least one elongate flexible cleaning member having a proximal end and a distal end, wherein at least a portion of the cleaning member is located within the at least one groove and is secured in place between the connectable-disconnectable members when the connectable-disconnectable members are connected together and wherein a remainder of the cleaning member extends away from the connectable-disconnectable members; and wherein at least one the connectable-disconnectable members includes a drive shaft joint where the drive shaft is removably connectable with at least one of the connectable-disconnectable members.

2. The component brush system of claim 1 wherein at least one of the connectable-disconnectable members is disk shaped.

3. The component brush system of claim 1 wherein at least one of the connectable-disconnectable members top surface or bottom surface is planar.

4. The component brush system of claim 3 wherein the top surface or bottom surface is planar in both an x-dimension and a y-dimension.

5. The component brush system of claim 1 wherein at least one of the connectable-disconnectable members includes a middle that is at least in part conical shaped.

6. The component brush system of claim 1 wherein at least one of the connectable-disconnectable members includes a middle that is at least in part bulbous shaped.

7. The component brush system of claim 1 wherein the first type of hole is positioned closer to a circumference of the connectable-disconnectable member than to the center of the connectable-disconnectable member.

8. The component brush system of claim 7 wherein the first type of hole includes a recessed portion and is free of threads.

9. The component brush system of claim 7 wherein each of the first type of hole is located generally equidistant from each adjacent first type of hole.

10. The component brush system of claim 7 wherein the second type of hole is positioned closer to the circumference of the connectable-disconnectable member than to the center of the connectable-disconnectable member.

11. The component brush system of claim 10 wherein each of the second type of hole is located generally equidistant from each adjacent second type of hole.

12. The component brush system of claim 10 wherein the first and second type of holes are located alternately about the circumference of the connectable-disconnectable member such that no two first type of holes are located adjacent each other.

13. The component brush system of claim 1 wherein each of the connectable-disconnectable members defines a diameter across its top and bottom surfaces and the diameter of adjacent top and bottom surfaces of each of the connectable-disconnectable members is the same.

14. The component brush system of claim 1 wherein the at least one groove includes a detent which assists in securing the cleaning member in place between the connectable-disconnectable members.

15. The component brush system of claim 14 wherein the detent comprises a ridge within a bottom of the groove which extends away from the bottom of the groove towards the surface of the connectable-disconnectable member.

16. The component brush system of claim 15 wherein the detent comprises the groove being sized smaller than a diameter of the cleaning member.

17. The component brush system of claim 1 wherein the at least one groove has a first end and a second end and at least one end intersects with a circumference of the connectable-disconnectable member.

18. The component brush system of claim 1 wherein the at least one groove has a first end and a second end and each end intersects with a circumference of the connectable-disconnectable member.

19. The component brush system of claim 18 wherein the groove is U-shaped.

20. The component brush system of claim 1 wherein the at least one groove comprises at least two pairs of grooves.

21. The component brush system of claim 20 wherein each pair of grooves is located about a circumference of the connectable-disconnectable member generally equidistant from each adjacent pair of grooves.

22. The component brush system of claim 1 wherein at least one of the connectable-disconnectable members includes at least one groove disposed in both the top surface and the bottom surface.

23. The component brush system of claim 1 wherein the at least one elongate flexible cleaning member has at least one of its distal end or its proximal end secured in place between the connectable-disconnectable members.

24. The component brush system of claim 1 wherein the at least one elongate flexible cleaning member has both its distal end and its proximal end secured in place between the connectable-disconnectable members such that the cleaning member forms a loop and where the ends are spaced apart from each other at a circumference of the connectable-disconnectable member.

25. The component brush system of claim 1 wherein the at least one elongate flexible cleaning member is secured in place between the connectable-disconnectable members at a middle portion such that the proximal end and the distal end extend away from the connectable-disconnectable members.

26. The component brush system of claim 1 wherein the at least one elongate flexible cleaning member comprises multiple pairs of elongate flexible cleaning members and each pair of cleaning members is located about a circumference of the connectable-disconnectable member generally equidistant from each adjacent pair of cleaning members.

27. The component brush system of claim 1 wherein the at least one elongate flexible cleaning member comprises multiple strands of elongate material.

28. The component brush system of claim 1 wherein the at least one elongate flexible cleaning member comprises multiple strands of elongate material and at least a portion of the multiple strands of elongate material is enclosed by a sheath.

29. The component brush system of claim 28 wherein at least one end of the cleaning member includes an outer portion that is free of the sheath such that the multiple strands can readily separate from each other.

30. The component brush system of claim 1 wherein the drive shaft joint comprises an axial bore located perpendicularly through the top and bottom surfaces and middle of at least one of the connectable-disconnectable members.

31. The component brush system of claim 30 wherein the axial bore is keyed to receive a mating keyed drive shaft portion therein.

32. A component brush system for use with a drive shaft comprising:

at least two identical connectable-disconnectable members, each connectable-disconnectable member having a top surface, a bottom surface and a middle sandwiched between the top and bottom surfaces;

at least a third connectable-disconnectable member, the third connectable-disconnectable member having a top surface, a bottom surface and a middle sandwiched between the top and bottom surfaces and wherein the at least two identical connectable-disconnectable members are connectable together independent of the third connectable-disconnectable member;

at least one groove disposed in at least a portion of each of the top and bottom surfaces of the at least two identical connectable-disconnectable members and at least one groove disposed in at least a portion of the bottom surface of the third connectable-disconnectable member;

at least one elongate flexible cleaning member located within at least one of the at least one grooves and secured in place between each connectable-disconnectable member for a total of at least two cleaning members when the at least two and the at least third connectable-disconnectable members are connected together and wherein a remainder of the cleaning members extends away from the connectable-disconnectable members; and wherein the third connectable-disconnectable member includes an axial bore located perpendicularly through at least the top surface and a portion of the middle of the third connectable-disconnectable member whereby the drive shaft is removably connectable with the third connectable-disconnectable member.

33. A component brush system for use with a drive shaft comprising:

at least two connectable-disconnectable members, each connectable-disconnectable member having a top surface, a bottom surface and a middle sandwiched between the top and bottom surfaces;

each of the connectable-disconnectable members having at least one groove disposed in at least a portion of each of its top and bottom surfaces, wherein at least one groove is located between the connectable-disconnectable members when the connectable-disconnectable members are connected together;

at least one elongate flexible cleaning member, each cleaning member having a proximal end and a distal end, wherein at least a portion of the cleaning member is located within at least one groove of the connectable-disconnectable members and is secured in place between the connectable-disconnectable members when the connectable-disconnectable members are connected together and wherein a remainder of the cleaning member extends away from the connectable-disconnectable members; and wherein at least one the connectable-disconnectable members includes a drive shaft joint where the drive shaft is removably connectable with at least one of the connectable-disconnectable members.

* * * * *